US010903032B2

(12) United States Patent
Leung

(10) Patent No.: US 10,903,032 B2
(45) Date of Patent: Jan. 26, 2021

(54) FUSE

(71) Applicant: GROUP TALENTS LIMITED, Hong Kong (CN)

(72) Inventor: Koon Yui Leung, Hong Kong (CN)

(73) Assignee: GROUP TALENTS LIMITED, Hong Kong (CN)

( * ) Notice: Subject to any disclaimer, the term of this patent is extended or adjusted under 35 U.S.C. 154(b) by 0 days.

(21) Appl. No.: 16/473,164

(22) PCT Filed: Dec. 20, 2017

(86) PCT No.: PCT/IB2017/058183
§ 371 (c)(1),
(2) Date: Jun. 24, 2019

(87) PCT Pub. No.: WO2018/116188
PCT Pub. Date: Jun. 28, 2018

(65) Prior Publication Data

US 2020/0090893 A1 Mar. 19, 2020

(30) Foreign Application Priority Data

Dec. 22, 2016 (CN) ..... 2016 2 1417122 U

(51) Int. Cl.
*H01H 85/143* (2006.01)
*H01H 85/50* (2006.01)
*H01H 85/175* (2006.01)

(52) U.S. Cl.
CPC ..... *H01H 85/143* (2013.01); *H01H 85/50* (2013.01); *H01H 85/1755* (2013.01)

(58) Field of Classification Search
CPC ..... H01H 69/02; H01H 85/08; H01H 85/143; H01H 85/157; H01H 85/175; H01H 85/1755
See application file for complete search history.

(56) References Cited

U.S. PATENT DOCUMENTS 1,349,269 A * 8/1920 Fernandez ..... H01H 85/143 337/290
1,443,886 A * 1/1923 Sands ..... H01H 85/143 337/234

(Continued)

FOREIGN PATENT DOCUMENTS

CN 101685734 A 3/2010
CN 20166732 U 12/2010

(Continued)

*Primary Examiner* — Jacob R Crum
(74) *Attorney, Agent, or Firm* — Muncy, Geissler, Olds & Lowe, P.C.

(57) ABSTRACT

A fuse includes an outer cartridge body, an inner cartridge body provided inside the outer cartridge body, a fuse core provided inside the inner cartridge body, two inner copper bushes provided at and covering two open ends of the outer cartridge body, and two outer copper bushes provided at and covering the two inner copper bushes and two open ends of the outer cartridge body. One end of one inner copper bush is a first open end, and the other end is a first closed end. An end face of the first closed end has a first opening. The first open end of the inner copper bush and the outer cartridge body form an interference fit. An end of the fuse core extends and passes through the first opening, and is fixed to the end face of the first closed end.

10 Claims, 2 Drawing Sheets

(56) References Cited

U.S. PATENT DOCUMENTS

| | | | | | |
|---|---|---|---|---|---|
| 1,447,798 | A * | 3/1923 | McDonald | H01H 85/157 | 337/237 |
| 1,485,822 | A * | 3/1924 | Appleton | H01H 85/157 | 337/234 |
| 1,585,646 | A * | 5/1926 | Bussmann | H01H 85/157 | 337/237 |
| 1,968,763 | A * | 7/1934 | Hanson | H01H 85/157 | 337/236 |
| 3,378,659 | A * | 4/1968 | Hitchcock | H01H 85/157 | 337/234 |
| 5,239,291 | A * | 8/1993 | Henricks | H01H 85/055 | 337/162 |
| 2004/0104801 | A1* | 6/2004 | Jollenbeck | H01H 85/0418 | 337/159 |
| 2018/0061607 | A1* | 3/2018 | Schlaak | H01H 69/02 | |

FOREIGN PATENT DOCUMENTS

| | | | |
|---|---|---|---|
| CN | 104810223 | A | 7/2015 |
| CN | 205282700 | U | 6/2016 |
| CN | 205303406 | U | 6/2016 |
| CN | 205692789 | U | 11/2016 |
| JP | 2012195207 | A | 10/2012 |

* cited by examiner

FUSE

TECHNICAL FIELD

The present invention relates to a fuse, particularly to a cartridge fuse (preferably double-cartridge fuse).

BACKGROUND OF THIS UTILITY MODEL

Fuse (fuse link) is a component which is connected to an electrical circuit for protection purpose. If there is overcurrent happening in the circuit, the metal wire or sheet metal within a fuse is melted at a high temperature which causing an open circuit to interrupt the current flow to protect the circuit from damage.

As for the fuses in market, there are mainly two types: single cartridge (ceramic cartridge) is provided with the inner and outer copper bushes, and the fuse wire is affixed by the inner and outer copper bushes; or single cartridge (melamine fiber cartridge) is provided with single copper bush, and the fuse wire is affixed with tin soldering.

In addition, there is also double-cartridge fuse. Presently, the double-cartridge design is mainly applied to fuse (fuse link) with pretty high rated current and voltage. The main body of such fuse is glass fiber coated with resin/melamine cartridge. Such cartridge has good electrical performance and strong arcing absorption performance, which is good for breaking capacity requirement for the fuse (fuse link). However, the cost of such cartridge is high, and its surface is not so smooth and pad printing cannot be directly conducted on such cartridge.

SUMMARY OF THIS UTILITY MODEL

A fuse is disclosed, comprising, an outer cartridge body with two open ends, an inner cartridge body with two open ends and provided inside the outer cartridge body, a fuse core provided inside the inner cartridge body, left and right inner copper bushes provided at and covering the two open ends of the outer cartridge body, left and right outer copper bushes provided at and covering the two inner copper bushes and both ends of the outer cartridge body;

Wherein, one end of one of the two inner copper bushes is a first open end, and the other end is a first closed end, an end face of the first closed end has a first opening; preferably, the first open end and the outer cartridge body form an interference fit through punching.

An end of the fuse core extends and passes through the first opening, and is preferably fixed to the end face of the first closed end through spot welding.

One end of one of the two outer copper bushes is an open end, and the other end is a closed end. Preferably, the open end of one of the two outer copper bushes and the first closed end and/or the outer cartridge body form an interference fit through punching.

In some embodiments, the fuse further include left and right pin copper bushes provided at and covering the two outer copper bushes and two open ends of the outer cartridge body; one end of the pin copper bush is a second open end, the other end is a second closed end. Preferably, an end face of the second closed end forms an opening part and pin part through punching. The pin part is configured to bend by 180 degrees toward an external side of the end face of the second closed end and to form a pin extending along a radial direction of the pin copper bush; preferably, the second open end and the closed end of the outer copper bush and/or the outer cartridge body form the an interference fit through punching.

In some embodiments, the pin part is a T-shape pin part. The pin part is configured to bend by 180 degrees toward the external side of end face of the second closed end so that a long part of the T-shape pin part forms the pin extending along the radial direction of the pin copper bush. An extending direction of the pin and an axial direction of the fuse are in an orthogonal direction.

In some other embodiments, the fuse includes a blocking component provided between the outer copper bushes and inner copper bushes and preferably covering the spot welded part of the end face of the first closed end. The blocking component is made of insulating material and is configured to improve current and/or arc blocking capacity of the fuse.

In some embodiments, an outside surface of the outer cartridge body has the printed labeling part.

In some embodiments, the outer cartridge body and inner cartridge body are made of different materials respectively, and they are closely sheathed to prevent loosening. The outer cartridge body is made of the material resisting high temperature, and the inner cartridge body is made of light and conveniently produced material; the outer cartridge body and inner cartridge body are configured to improve the electrical performance of the fuse and reduce the gross cost of the fuse requiring high electrical performance.

In some embodiments, the outer cartridge body is made of ceramic or glass, and the inner cartridge body is made of glass fiber, polyester, resin, glass fiber resin and/or melamine. The inner diameters and outer diameters of the outer cartridge body and inner cartridge body are designed to make the outer cartridge body and inner cartridge body to conveniently and closely sheath; and/or adhesive substance or adhesive agent is provided between the outer cartridge body and inner cartridge body to fix them together.

In some embodiments, shapes of the first opening include the semicircle shape, triangular shape, rectangular shape, polygonal shape and/or combination of such shapes.

In some embodiments, the fuse core is linear-shaped or sheet-shaped; and/or the fuse core is sheet-shaped with several mutually separated holes.

In some embodiments, the fuse core extends along an axial direction of the inner cartridge body; and/or a longitudinal axis of the fuse core coincides with or parallels to a longitudinal axis of the inner cartridge body.

DESCRIPTION OF ATTACHED DRAWINGS

In the following, with referring to the attached drawings and embodiments, the technical solution of the present disclosure will be described. The attached drawings include:

EMBODIMENT

In the following, some preferred embodiments of the present disclosure are given through combining the attached drawings in order to provide detailed description of the technical solution.

Figure 1:
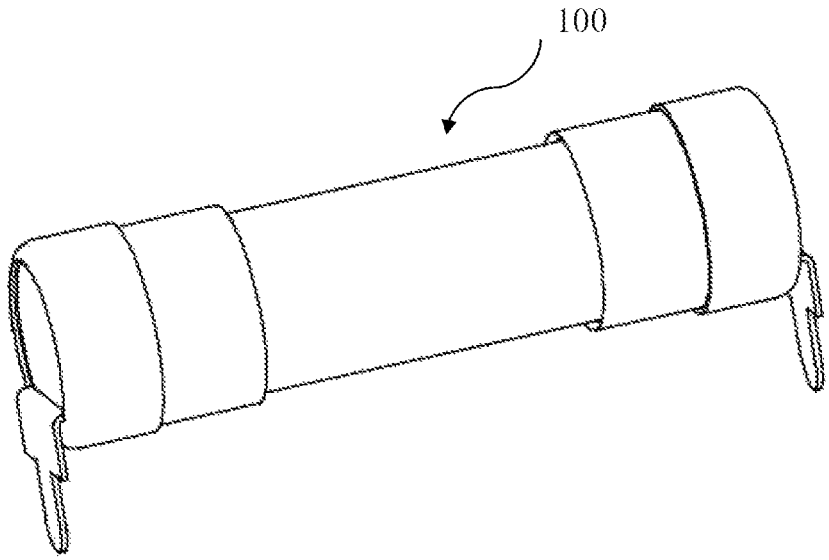
FIG. 1 is a schematic illustration of the fuse in accordance with the embodiment of the present disclosure.
Figure 2:
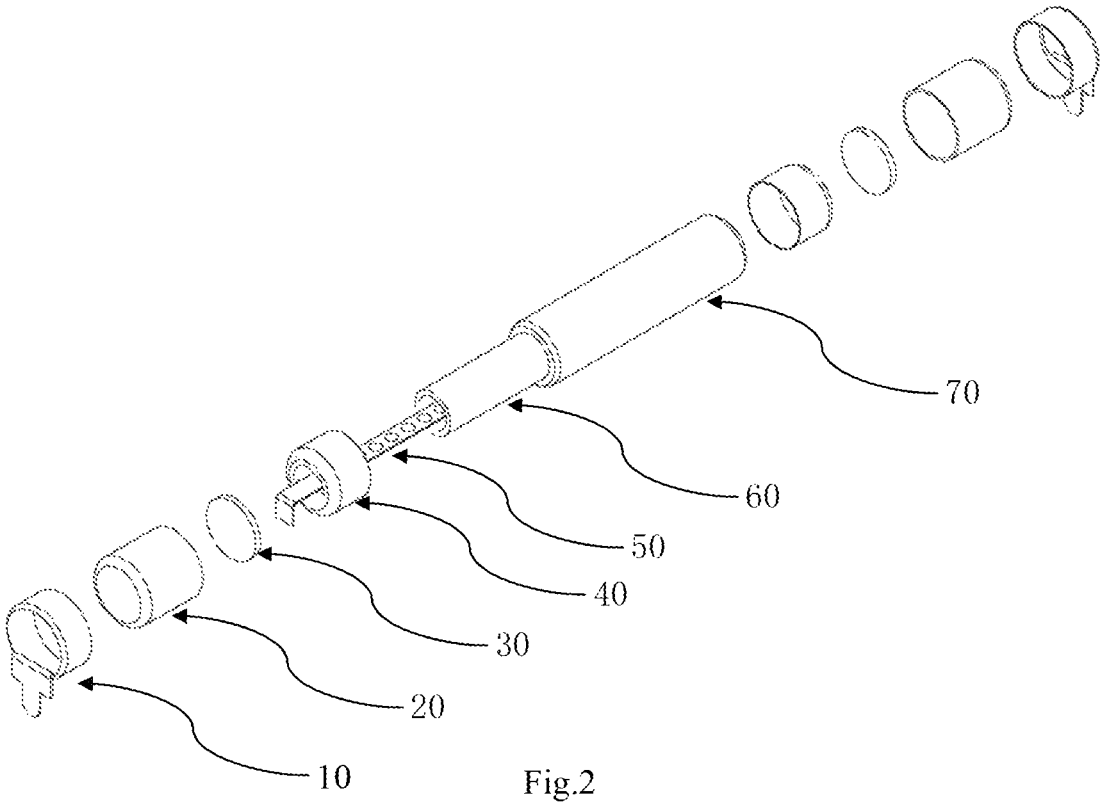
FIG. 2 is an exploded drawing of the fuse in FIG. 1.

Referring to FIGS. 1-2, the schematic illustration and exploded drawing of the fuse 100 of the present disclosure are shown as respectively. As shown in the figures, the fuse 100 is a double-cartridge fuse 100, including an outer cartridge body 70 with two open ends, an inner cartridge body 60 with two open ends and provided inside the outer cartridge body 70, a fuse core 50 provided inside the inner cartridge body 60, left and right inner copper bushes 40 provided at and covering the two open ends of the outer cartridge body 70, left and right outer copper bushes 20 provided at and covering the inner copper bushes 40 and the two open ends of the outer cartridge body 70.

In some embodiments, the fuse 100 is a single-cartridge fuse, namely including the outer cartridge body 70 only. The other structure is generally identical to those shown in FIGS. 1-2.

In some embodiments, an outer surface of the outer cartridge body 70 has a part for printing marked performance and parameters.

In some embodiments, the fuse core 50 presents in form of a wire or sheet shape. Preferably, the fuse core 50 is sheet-shaped with several mutually separated holes, as shown in FIG. 2.

In some embodiments, the fuse core 50 extends along an axial direction of the inner cartridge body 60; and/or a longitudinal axis of the fuse core 50 coincides with or parallels to a longitudinal axis of the inner cartridge body, as shown in FIG. 2.

According to the present disclosure, one end of one of the two inner copper bushes 40 is a first open end adjoining the outer cartridge body 70, the other end is a first closed end distant from the outer cartridge body 70. An end face 44 of the first closed end has a first opening 42; preferably, the first open end and the outer cartridge body 70 form an interference fit. The end face 44 includes a supporting surface 441 and a projecting surface 442 which are connected to each other to form the first opening 42.

Compared with existing technology that the inner copper bush has both open ends and has the same diameter, the inner copper bush 40 in the present disclosure has fairly much copper material. In this way, it can assist the fuse 100 (fuse link) to reduce the internal resistance, maintain fine electrical contact and reduce temperature rise when the fuse 100 (fuse link) is energized.

Figure 3:
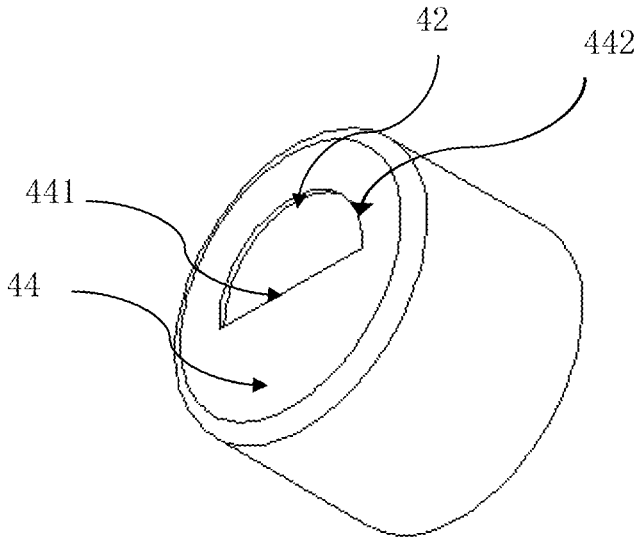
FIG. 3 is the schematic illustration of the inner copper bush of the fuse in accordance with the embodiment of the present disclosure.

In some embodiments, shapes of the first opening 42 include the semicircle shape, triangular shape, rectangular shape, polygonal shape and/or combination of such shapes. As shown in FIG. 3, the first opening 42 is semi-circle shaped at the end face 44 of the first closed end. In some embodiments, an end of the fuse core 50 in the present disclosure extends and passes through the first opening 42, is preferably fixed on the supporting surface 441 of the end face 44 of the first closed end through spot welding.

Compared with the fuse utilizing the current technology that the fuse core/fuse wire is generally fixed through welding the ring edge/end side of the inner copper bush with tin wire, the end face 44 in the present disclosure provides a supporting surface 441 and the projecting surface 442 which are connected to each other to form the first opening 42, and thus the fuse core 50 can be fixed on the supporting surface 441 of the end face 44 through spot welding and the tin soldering method is not required. The projecting surface 442 of the end face 44 has no contact with the fuse core 50. In this way, the temperature rise of fuse 100 (fuse link) caused by external heating can be reduced, and effect on the electrical conductivity is reduced.

As shown in the figures, one end of the outer copper bush 20 is an open end, and the other end is a closed end. Preferably, the open end of the outer copper bush 20 and the first closed end and/or the outer cartridge body 70 form an interference fit through punching. In operation, the outer copper bush 20 of the fuse 100 is connected to a circuit board via the known clamping component, or can be plugged into a special socket of the circuit board to protect circuits from damage caused by over-current.

In some embodiments, the fuse 100 includes left and right pin copper bushes 10 provided at and covering the outer copper bushes and the two open ends of the outer cartridge body 70.

Figures 4A, 4B:
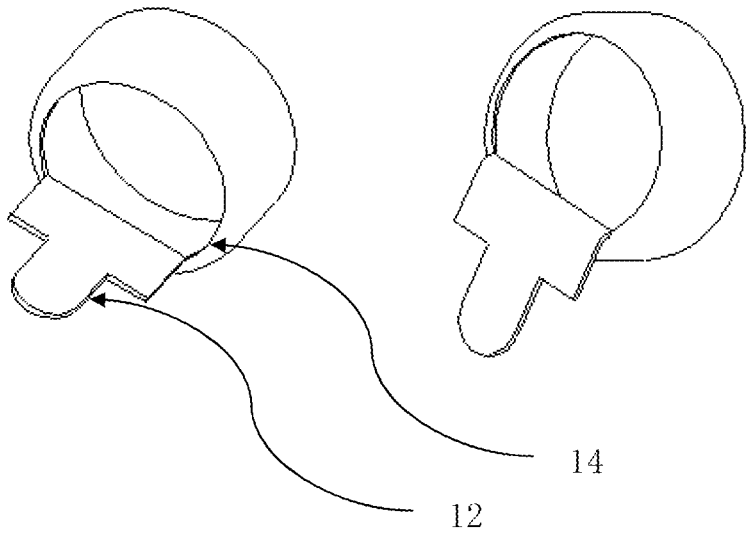
FIGS. 4*a*-4*b* are schematic illustrations of the pin copper bushes with various shapes of the fuse in accordance with the embodiment of the present disclosure.

As shown in FIGS. 4*a*-4*b*, one end of pin copper bush 10 is a second open end, and the other end is a second closed end. Preferably, the end face 14 of the second closed end forms a opening part and a pin part 12 through punching. The pin part 12 is configured to bend by 180 degrees toward the external side of the end face 14 of the second closed end and to form the pin extending along a radial direction of the pin copper bush 10; preferably, through pressing, the second open end and the closed end of the outer copper bush 20 and/or the outer cartridge body 70 form the an interference fit.

As shown in the figure, the pin part 12 preferably is a T-shape pin part. The pin part 12 is configured to bend by 180 degrees toward the external side of the end face 14 of the second closed end so that a long part of the T-shape pin part forms the pin extending along a radial direction of the pin copper bush 10. An extending direction of the pin and an axial direction of the fuse 100 are orthogonal and mutually perpendicular.

As shown in the figures, the pin copper bushes 10 are mounted to both ends of the fuse 100 (fuse link) so that the fuse can be mounted or fixed to a PCB for use. The pin copper bush 10 is mechanically fixed, soldering tin is not required in order to reduce temperature rise of the fuse (fuse link) passing the tin oven (in case of solder-reflow/wave-front soldering) and reduce effect caused by externally heating fuse (fuse link) on the electrical conductivity of the fuse core 50; the fuse (fuse link) can be integrated with the pin copper bush 10 in formation so that the fuse (fuse link) can be conveniently and directly welded to a PCB. The pin copper bush 10 in the present disclosure makes the user to difficultly or impossibly remove the pin copper bush 10 from the fuse (fuse link), which is different from application of copper clamp for the fuse wire of the existing technology. In other words, if it needs to replace the fuse (fuse link), the entire fuse (fuse link) and the pin copper bush 10 must be removed from the PCB together. This requires the experienced technical person to replace the fuse (fuse link) with the relevant apparatuses, safety of the ordinary and non-technical person is guaranteed and safety of the end user can also be guaranteed.

In addition, the shape design of the pin copper bush 10 of the fuse wire (fuse) can save material. The pin part 12 is formed through inverse bending toward the external side from the end face or bottom of the pin copper bush 10, and the material at the end face or the plain surface portion of the pin copper bush 10 is fully used.

In some embodiments, the fuse 100 includes a blocking component 30 provided between the outer copper bushes 20 and inner copper bushes 40 and preferably covering a spot welded part of the end face of the first closed end. The blocking component 30 is made of insulating material and is configured to improve current and/or arc blocking capacity of the fuse 100. As shown in FIG. 2, the blocking component 30 can be formed to be circle shaped; in other embodiments, shapes of the blocking piece 30 can be semicircle shape, triangular shape, rectangular shape, polygonal shape and/or combination of such shapes.

In some embodiments, the outer cartridge body 70 and inner cartridge body 60 are made of two different materials respectively, and they are closely sheathed to prevent loosening. The outer cartridge body 70 is made of the material resisting high temperature, and the inner cartridge body 60 is made of light and conveniently produced material, vice versa (depending on the specific application); the outer cartridge body 70 and inner cartridge body 60 are configured to improve the electrical performance of the fuse and reduce the gross cost of the fuse requiring high electrical performance.

In some embodiments, the outer cartridge body 70 is preferably made of ceramic or glass, and the inner cartridge body 60 is preferably made of glass fiber, polyester, resin, glass fiber resin and/or melamine. In some other specific embodiments, the inner cartridge body 60 is preferably made of ceramic or glass, and the outer cartridge body 70 is preferably made of glass fiber, polyester, resin, glass fiber resin and/or melamine. The inner diameters and outer diameters of the outer cartridge body 70 and inner cartridge body 60 are designed to make the outer cartridge body 70 and inner cartridge body 60 to conveniently and closely sheath; and/or adhesive substance or adhesive agent is provided between the outer cartridge body 70 and inner cartridge body 60 to fix them together.

With application of the double-cartridge fuse in the present disclosure, the breaking capacity of the fuse (fuse link) can be greatly higher than that of the single cartridge fuse; secondly, the material cost can be reduced; in addition, the performance labeling problem of the fuse (fuse link) can be solved, it does not need to use the paper label that are easier to fall off and damaged.

The characteristics under the attached claims (jointly and separately in proper place) form a part of the present disclosure, and are introduced herein for reference.

The invention claimed is:

1. A fuse, comprising
an outer cartridge body with two open ends,
an inner cartridge body with two open ends and provided inside the outer cartridge body,
a fuse core provided inside the inner cartridge body,
two inner copper bushes provided at and covering the two open ends of the outer cartridge body,
two outer copper bushes provided at and covering the two inner copper bushes and the two open ends of the outer cartridge body;
wherein one end of one of the two inner copper bushes is a first open end, and the other end is a first closed end,
an end face of the first closed end has a first opening, wherein the end face includes a supporting surface and a projecting surface which are connected to each other to form the first opening;
the first open end and the outer cartridge body form an interference fit through punching;
an end of the fuse core extends and passes through the first opening, and is fixed on the supporting surface of the end face of the first closed end through spot welding, wherein the projecting surface of the end face has no contact with the end of the fuse core;
one end of one of the two outer copper bushes is an open end, the other end is a closed end; and
through pressing, the open end of one of the two outer copper bushes and the said-first closed end and/or the outer cartridge body form an interference fit.

2. The fuse of claim 1, further comprising two pin copper bushes provided at and covering the two outer copper bushes and the two open ends of the outer cartridge body;
one end of each of the two pin copper bushes is a second open end, the other end is a second closed end; an end face of the second closed end forms an opening part and a pin part through punching; the pin part is configured to bend by 180 degrees toward an external side of the end face of the second closed end and to form a pin extending along a radial direction of one of the two pin copper bushes; through punching, the second open end and the closed end of one of the two outer copper bushes and/or the outer cartridge body form an interference fit.

3. The fuse of claim 2, wherein the pin part is a T-shape pin part; the pin part is configured to bend by 180 degrees toward the external side of the end face of the second closed end so that a long part of the T-shape pin part forms the pin extending along the radial direction of one of the two pin copper bushes; an extending direction of the pin and an axial direction of the fuse are orthogonal.

4. The fuse of claim 1, further comprising a blocking component provided between the two outer copper bushes and the two inner copper bushes and covering a spot welded part of the end face of the first closed end; the blocking component is made of insulating material.

5. The fuse of claim 1, wherein an outer surface of the outer cartridge body has a printed labeling part.

6. The fuse of claim 1, wherein shapes of the first opening include semicircle shape, triangular shape, rectangular shape, polygonal shape and/or combination of such shapes.

7. The fuse of claim 1, wherein the fuse core is linear shaped or sheet shaped; and/or the fuse core is sheet shaped with several mutually separated holes.

8. The fuse of claim 1, wherein the fuse core extends along an axial direction of the inner cartridge body; and/or a longitudinal axis of the fuse core coincides with or parallels to a longitudinal axis of the inner cartridge body.

9. The fuse of claim 1, wherein the outer cartridge body and inner cartridge body are made of different materials respectively, and are closely connected to prevent loosening; wherein the outer cartridge body is made of the material resisting high temperature, and the said-inner cartridge body is made of light and conveniently produced material.

10. The fuse of claim 1, wherein the outer cartridge body is made of ceramic or glass, and the inner cartridge body is made of glass fiber, polyester, resin, glass fiber resin and/or melamine; inner diameters and outer diameters of the outer cartridge body and inner cartridge body are designed to make the outer cartridge body and inner cartridge body to conveniently and closely sheath; and/or adhesive substance or adhesive agent is provided between the outer cartridge body and inner cartridge body to fix them together.

* * * * *